US011518013B2

(12) United States Patent
Chien et al.

(10) Patent No.: US 11,518,013 B2
(45) Date of Patent: Dec. 6, 2022

(54) ELECTRIC NAIL GUN

(71) Applicant: BASSO INDUSTRY CORP., Taichung (TW)

(72) Inventors: Chia-Yu Chien, Taichung (TW); Liang-Chi Hung, Taichung (TW)

(73) Assignee: Basso Industry Corp., Taichung (TW)

( * ) Notice: Subject to any disclaimer, the term of this patent is extended or adjusted under 35 U.S.C. 154(b) by 206 days.

(21) Appl. No.: 16/751,855

(22) Filed: Jan. 24, 2020

(65) Prior Publication Data

US 2020/0238491 A1 Jul. 30, 2020

(30) Foreign Application Priority Data

Jan. 30, 2019 (TW) ..... 108103566

(51) Int. Cl.
*B25C 1/00* (2006.01)
*B25C 1/06* (2006.01)

(52) U.S. Cl.
CPC ..... *B25C 1/008* (2013.01); *B25C 1/06* (2013.01)

(58) Field of Classification Search
CPC . B25C 1/06; B25C 1/008; B25F 5/001; B25F 5/02
See application file for complete search history.

(56) References Cited

U.S. PATENT DOCUMENTS 6,669,072 B2 * 12/2003 Burke ..... B25C 1/06 173/122
7,506,788 B2 * 3/2009 Liang ..... B25C 1/06 227/129
8,479,966 B2 * 7/2013 Chien ..... B25C 1/06 227/131
8,511,532 B2 * 8/2013 Chien ..... B25C 1/06 227/133
2005/0218178 A1 * 10/2005 Berry ..... B25C 1/06 227/8

(Continued)

FOREIGN PATENT DOCUMENTS

CN 202162778 U 3/2012
EP 2431131 A2 3/2012

(Continued)

OTHER PUBLICATIONS

Combined Search and Examination Report issued to U.K. counterpart application No. GB2001126.8 by UK Intellectual Property Office dated Jul. 6, 2020.

*Primary Examiner* — Nathaniel C Chukwurah
*Assistant Examiner* — Lucas E. A. Palmer
(74) *Attorney, Agent, or Firm* — Burris Law, PLLC

(57) ABSTRACT

An electric nail gun includes a supporting frame, a swing arm, a driving unit, and a safety unit. The swing arm has a driven segment and is pivotable relative to the supporting frame between a standby position and a shooting position. The driving unit includes a driving member in contact with the driven segment of the swing arm and operable for moving the swing arm towards the shooting position. The safety unit has a stopping member that is driven by the driving member to move relative to the driven segment between a stopping position, where the stopping member blocks movement of the driven segment, and a releasing position, where the movement of the swing arm towards the shooting position is permitted.

8 Claims, 9 Drawing Sheets

(56) References Cited

U.S. PATENT DOCUMENTS

2006/0261125 A1* 11/2006 Schiestl ..... B25C 1/06 227/131
2008/0257933 A1* 10/2008 Takahashi ..... B25C 5/15 227/129
2009/0032567 A1* 2/2009 Liang ..... B25C 1/06 227/131
2010/0038397 A1* 2/2010 Krondorfer ..... B25C 1/06 227/8
2011/0094847 A1* 4/2011 Hirabayashi ..... B25C 1/06 192/105 R
2011/0259937 A1* 10/2011 Chien ..... B25C 1/06 227/120
2012/0067934 A1* 3/2012 Li ..... B25C 1/008 227/8
2012/0074195 A1* 3/2012 Chien ..... B25C 1/06 227/147
2013/0153254 A1* 6/2013 Liang ..... B25C 1/06 173/114
2013/0255447 A1* 10/2013 Po ..... B25B 21/00 81/57.11
2013/0255984 A1* 10/2013 Po ..... B25C 1/06 173/112
2015/0034345 A1* 2/2015 Po ..... B25C 1/06 173/46
2015/0251300 A1* 9/2015 Po ..... B25C 1/06 227/132
2017/0100828 A1* 4/2017 Chien ..... B25C 1/08
2018/0015600 A1* 1/2018 Akiba ..... B25C 1/008
2020/0238491 A1* 7/2020 Chien ..... B25C 1/008
2020/0246951 A1* 8/2020 Chien ..... B25C 1/06
2020/0246952 A1* 8/2020 Chien ..... B25C 1/06
2021/0122019 A1* 4/2021 Lai ..... B25C 1/06
2021/0237246 A1* 8/2021 Chien ..... B25F 5/008

FOREIGN PATENT DOCUMENTS

EP 3156182 A2 4/2017
TW I532571 B 5/2016
WO 2005/097419 A2 10/2005

* cited by examiner

ELECTRIC NAIL GUN

CROSS-REFERENCE TO RELATED APPLICATION

This application claims priority of Taiwanese Invention Patent Application No. 108103566, filed on Jan. 30, 2019.

FIELD

The disclosure relates to an electric nail gun, more particularly to an electrical nail gun having a safety unit.

BACKGROUND

Referring to FIG. 1, a conventional nail gun 1 as disclosed by Taiwanese Invention Patent No. I532571 includes a supporting frame 11, a flywheel 12 rotatably mounted to the supporting frame 11, a swing arm 13 mounted pivotally to the supporting frame 11 and movable relative to the flywheel 12, an impact member 14 movably disposed on the swing arm 13, a control member 15 rotatably mounted to the supporting frame 11, and a driving unit 16 mounted to the supporting frame 11. The control member 15 is in sliding contact with an abutting surface 131 of the swing arm 13. The driving unit 16 drives the control member 15 to press against the abutting surface 131 such that the swing arm 13 is driven downward. The swing arm 13 then brings the impact member 14 into contact with the flywheel 12 to complete a nailing action. The rotation of the control member 15 drives the swing arm 13 to move stably and smoothly.

The position of the swing arm 13 determines if the nailing action is performed. As such, if the conventional nail gun 1 experiences an unintentional external impact, the swing arm 13 may be moved and unexpectedly bring the impact member 14 into contact with the flywheel 12. This would cause the conventional nail gun 1 to perform an accidental and unsafe nailing action.

SUMMARY

Therefore, the object of the disclosure is to provide an electric nail gun which can alleviate the drawback of the prior art.

According to the disclosure, an electric nail gun includes a supporting frame, a flywheel rotatably connected to the supporting frame, a swing arm connected to the supporting frame, an impact member mounted to the swing arm, a driving unit, and a safety unit.

The swing arm has a driven segment and is pivotable relative to the supporting frame between a standby position, where the swing arm is distal from the flywheel, and a shooting position, where the swing arm is proximal to the flywheel.

The impact member contacts the flywheel and is driven by the flywheel to move in a longitudinal direction when the swing arm is at the shooting position.

The driving unit includes a driving member in contact with the driven segment of the swing arm and operable for moving the swing arm towards the shooting position.

The safety unit has a stopping member that is driven by the driving member to move relative to the driven segment between a stopping position, where the stopping member blocks movement of the driven segment to prevent the swing arm from moving towards the shooting position, and a releasing position, where the movement of the driven segment is not blocked such that movement of the swing arm towards the shooting position is permitted.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
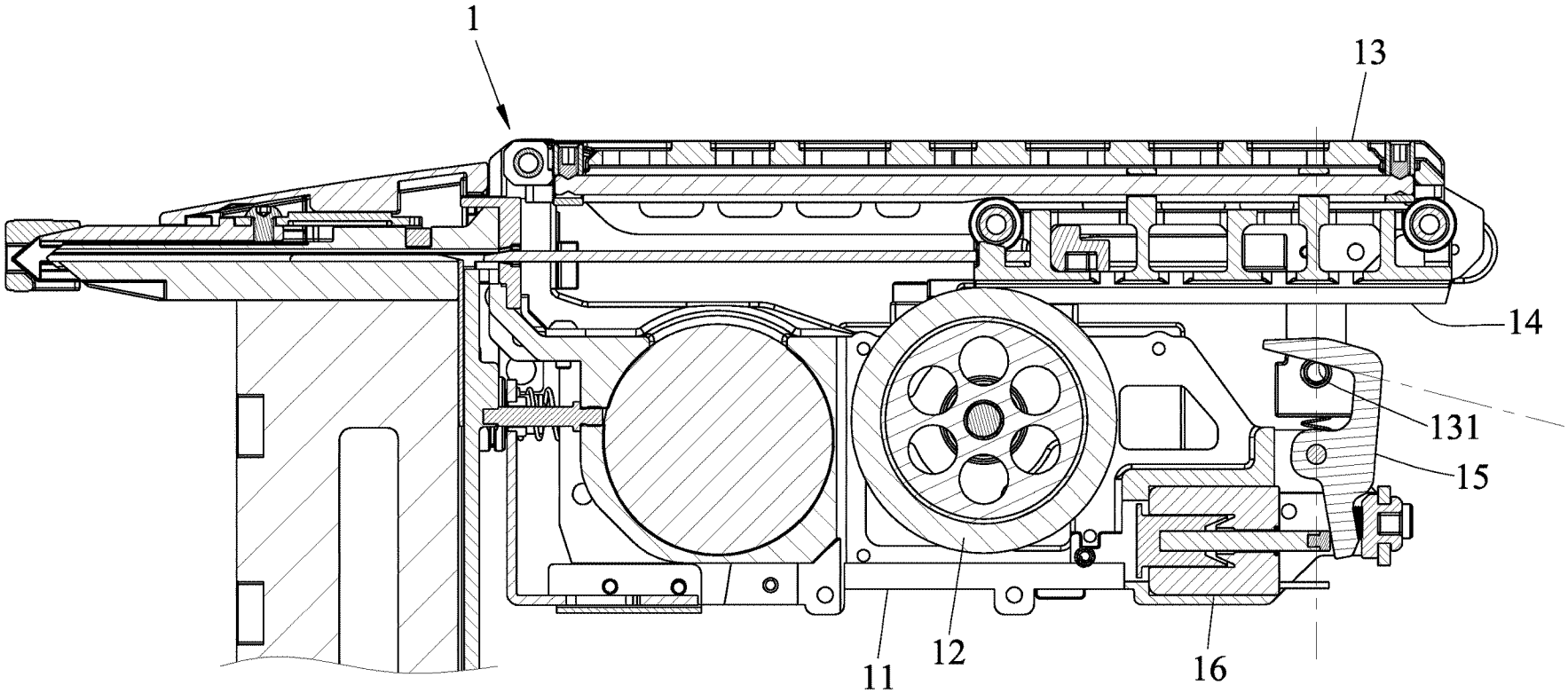
FIG.1 PRIOR ART
FIG. 1 is a fragmentary sectional view of a conventional electric nail gun as disclosed by Taiwanese Invention Patent No. I532571.
Figure 2:
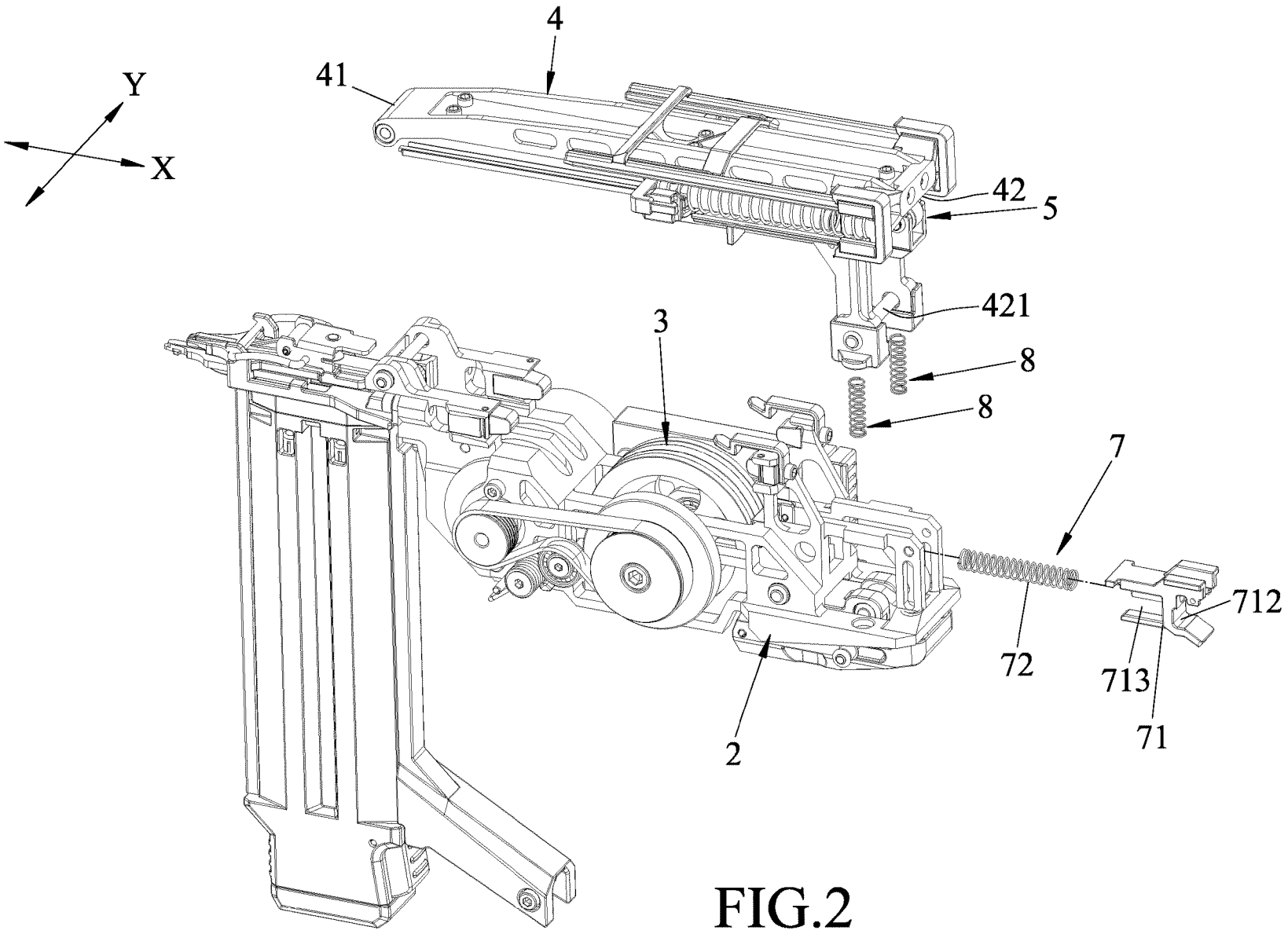
FIG. 2 is a partly exploded perspective view of a first embodiment of an electrical nail gun according to the disclosure.
Figure 3:
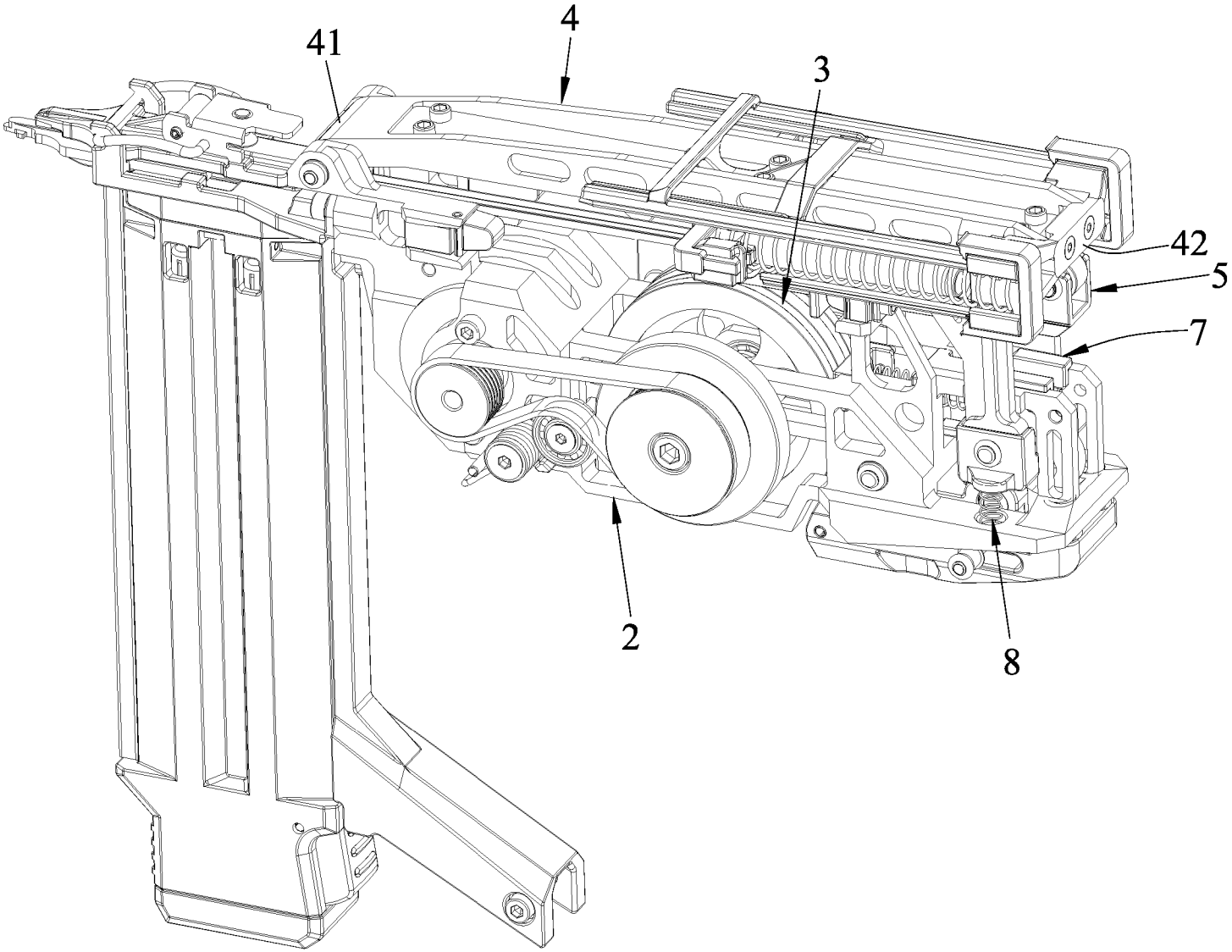
FIG. 3 is a perspective view of the first embodiment.

Before the present invention is described in greater detail, it should be noted that where considered appropriate, reference numerals or terminal portions of reference numerals have been repeated among the figures to indicate corresponding or analogous elements, which may optionally have similar characteristics.

Referring FIGS. 2 to 5, a first embodiment of an electric nail gun according to this disclosure includes a supporting frame 2, a flywheel 3, a swing arm 4, an impact member 5, a driving unit 6, a safety unit 7, and two restoring resilient members 8.

The flywheel 3 is rotatably connected to the supporting frame 2 and electronically driven to rotate.

The swing arm 4 is connected to the supporting frame 2 and is pivotable relative to the supporting frame 2 between a standby position (FIG. 4), where the swing arm 4 is distal from the flywheel, and a shooting position (FIG. 6), where the swing arm 4 is proximal to the flywheel 3. The swing arm 4 includes a pivot end portion 41 pivotally connected to the supporting frame 2, and a swing end portion 42 opposite to the pivot end portion 41 and having a driven segment 421. In this embodiment, the driven segment 421 is rod-shaped.

The impact member 5 is slidably mounted to the swing arm 4. When the swing arm 4 is at the shooting position, the impact member 5 contacts the flywheel 3 and is driven by the flywheel 3 to move in a longitudinal direction (X) to complete a nailing action. In this embodiment, the driven segment 421 of the swing end portion 42 of the swing arm 4 extends in a width direction (Y) which is perpendicular to the longitudinal direction (X).

The driving unit 6 includes a driving member 61 mounted rotatably to the supporting frame 2, and an electromagnetic valve 62 mounted to the supporting frame 2. The driving member 61 is in contact with the driven segment 421 of the swing arm 4, operable for moving the swing arm 4 towards the shooting position, and has opposite first and second rotating arms 611, 612. The first rotating arm 611 is in sliding contact with the driven segment 421 of the swing arm 4 such that rotation of the driving member 61 in a rotational direction drives the swing arm 4 to move towards the shooting position. The electromagnetic valve 62 is operable for generating a force to rotate the driving member 61 in the rotational direction and has a valve rod set 621 connected to the second rotating arm 612 and movable in the longitudinal direction (X). In this embodiment, the rotational direction is an anti-clockwise direction as seen from the side shown in FIG. 7.

The safety unit 7 has a stopping member 71 mounted to the supporting frame 2 and movable along the longitudinal direction (X), and a safety resilient member 72.

The stopping member 71 is driven by the driving member 61 to move relative to the driven segment 421 between a stopping position (FIG. 5), where the stopping member 71 blocks movement of the driven segment 421 to prevent the swing arm 4 from moving towards the shooting position, and a releasing position (FIG. 7), where the movement of the driven segment 421 is not blocked such that movement of the swing arm 4 towards the shooting position is permitted. The stopping member 71 has an abutting surface 711, a stopping surface 712, and a recess 713. The stopping surface 712 and the abutting surface 711 are not parallel to each other.

The recess 713 is engaged with an end portion of the safety resilient member 72. The safety resilient member 72 is connected between the recess 713 of the stopping member 71 and the supporting frame 2 for biasing the stopping member 71 towards the stopping position. The abutting surface 711 is in contact with the first rotating arm 611 such that the rotation of the driving member 61 in the rotational direction drives the stopping member 71 to move towards the releasing position against the bias of the safety resilient member 72.

The restoring resilient members 8 are disposed between the supporting frame 2 and the swing end portion 42 of the swing arm 4 for biasing the swing arm 4 towards the standby position.

Figure 4:
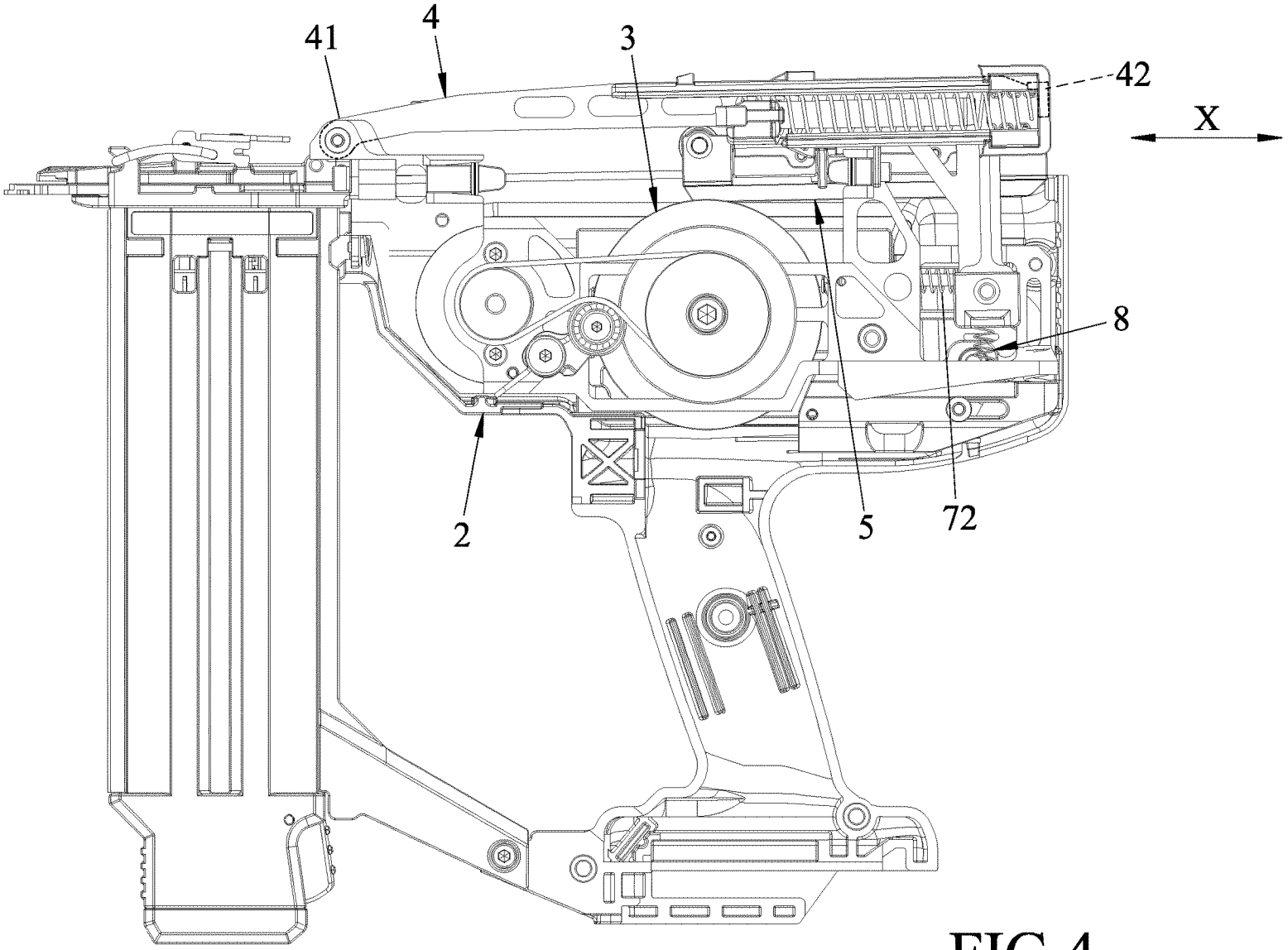
FIG. 4 is a side view illustrating a swing arm of the first embodiment in a standby position.
Figure 5:
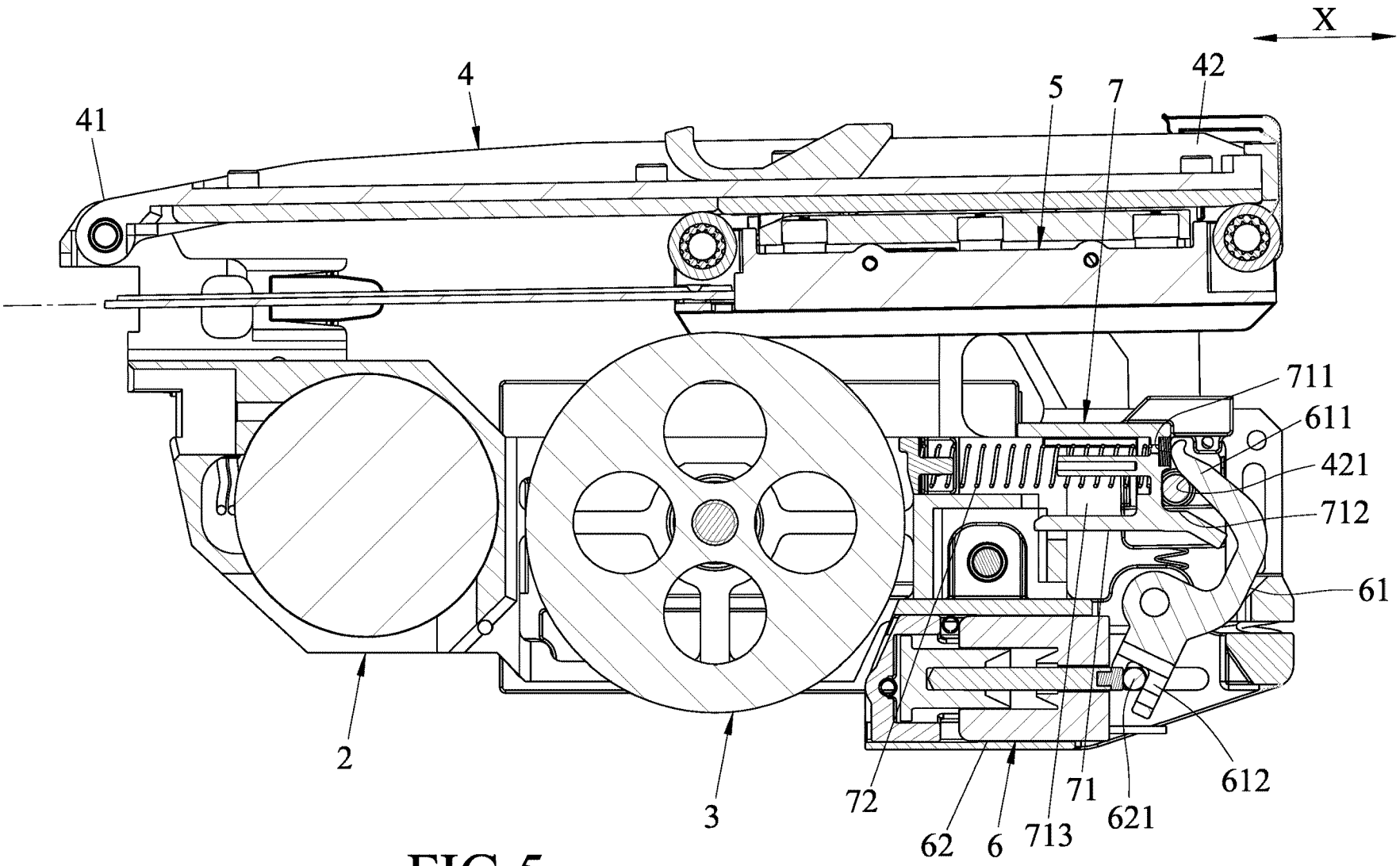
FIG. 5 is a partial sectional view illustrating a stopping member of the first embodiment in a stopping position.

Referring to FIGS. 4 and 5, when the electric nail gun is in standby, the valve rod set 621 of the electromagnetic valve 62 retracts when no electricity is supplied, which drives the driving member 61 to rotate in a clockwise direction (opposite to the rotational direction) so that the first rotating arm 611 pivots away from the stopping member 71. In this state, the first rotating arm 61 does not drive the driven segment 421 of the swing arm 4 downwards, allowing the swing end portion 42 of the swing arm 4 to be biased by the restoring resilient members 8 away from the flywheel 3 to move the swing arm 4 into the standby position so that the impact member 5 is spaced-apart from the flywheel 3.

At the same time, the stopping member 71 is biased by the safety resilient member 72 towards the driving member 61 to the stopping position where the stopping surface 712 is disposed on a route of the driven segment 421 during the movement of the swing arm 4 from the standby position to the shooting position such that the swing arm 4 is restricted from swing movement. In this state, if an unintentional force is exerted on the electric nail gun, the swing end portion 42 of the swing arm 4 is blocked by the stopping member 71 so the swing arm 4 is prevented from moving to the shooting position.

Figure 6:
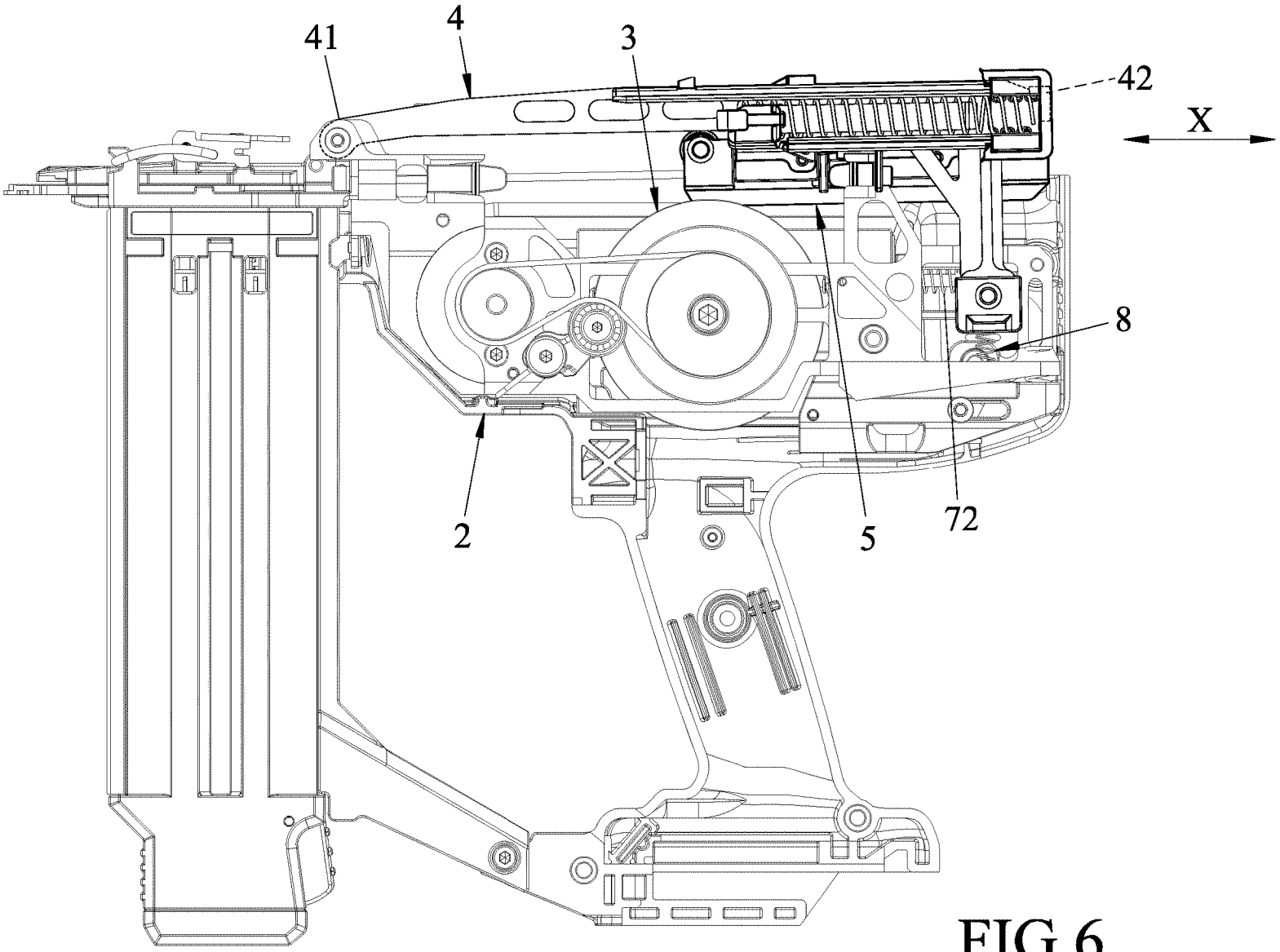
FIG. 6 is similar to FIG. 4 but illustrating the swing arm in a shooting position.
Figure 7:
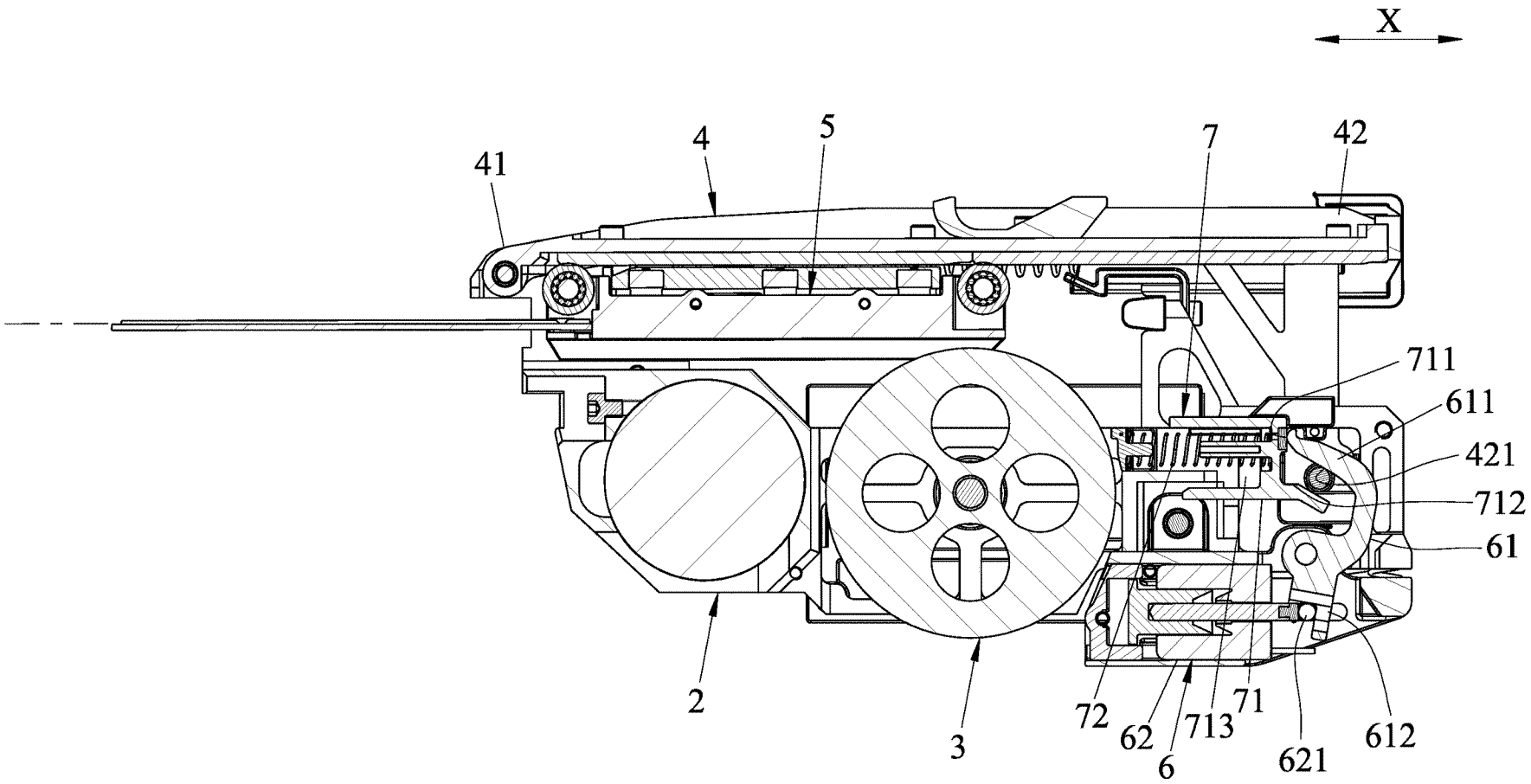
FIG. 7 is similar to FIG. 5 but illustrating the stopping member in a releasing position.

Referring to FIGS. 6 and 7, when electricity is supplied to cause the valve rod set 621 of the electromagnetic valve 61 to extend, the driving member 61 is driven by the valve rod set 621 to rotate in the rotational direction so that the first rotating arm 611 pivots towards and contacts the abutting surface 711 of the stopping member 71 to drive the stopping member 71 to move against the bias of the safety resilient member 72 to the releasing position. At the releasing position, the stopping surface 712 is away from the route of the driven segment 421 during the movement of the swing arm 4 from the standby position to the shooting position. Simultaneously, the driving member 61 drives the swing arm 4 to move towards the flywheel 3 to the shooting position, bringing the impact member 5 into contact with the flywheel 3 so that the impact member 5 experiences a large force from the flywheel 3 to move in the longitudinal direction (X) and completes the nailing action.

Figure 8:
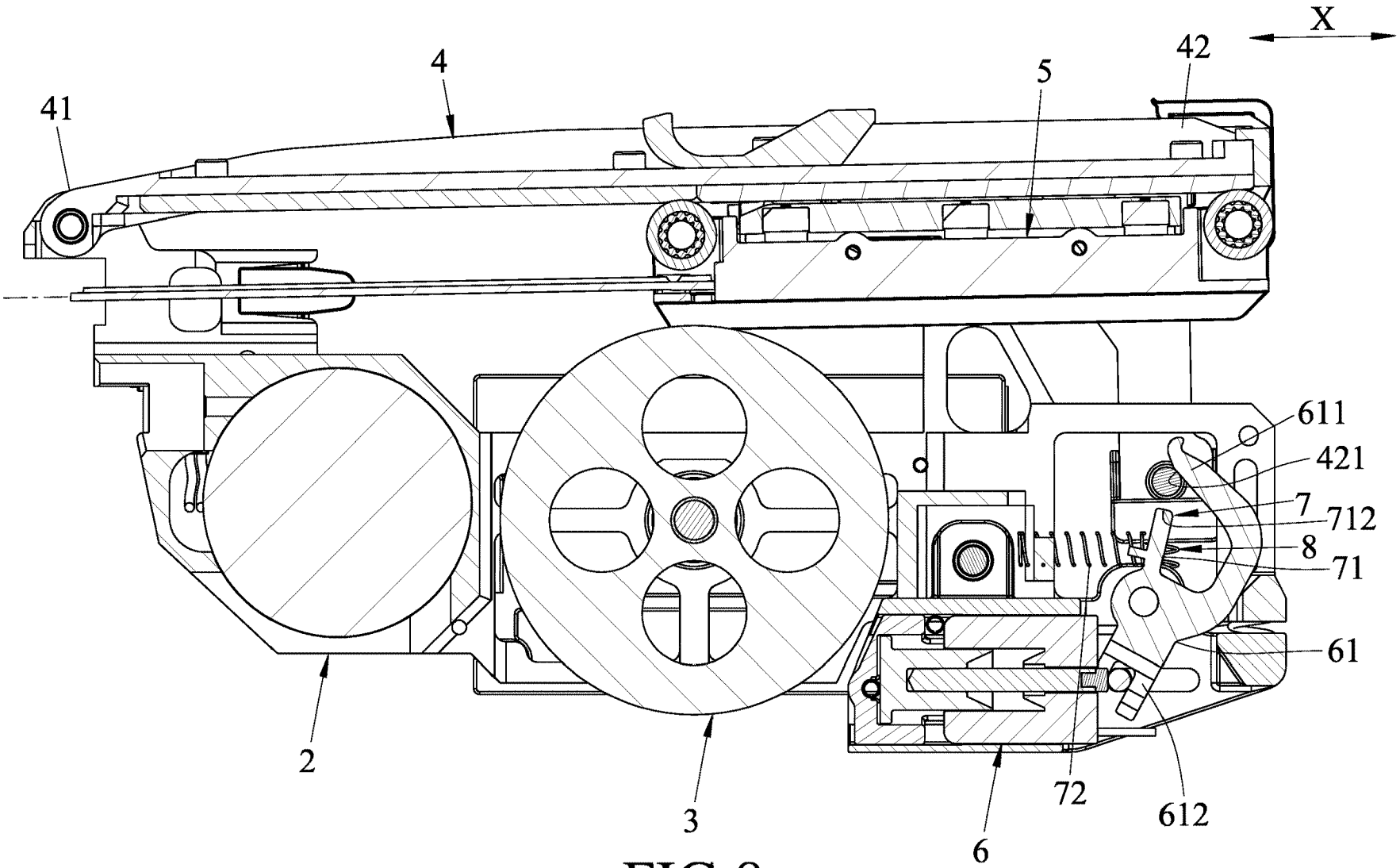
FIG. 8 is a partial sectional view of a second embodiment of an electric nail gun according to the disclosure.
Figure 9:
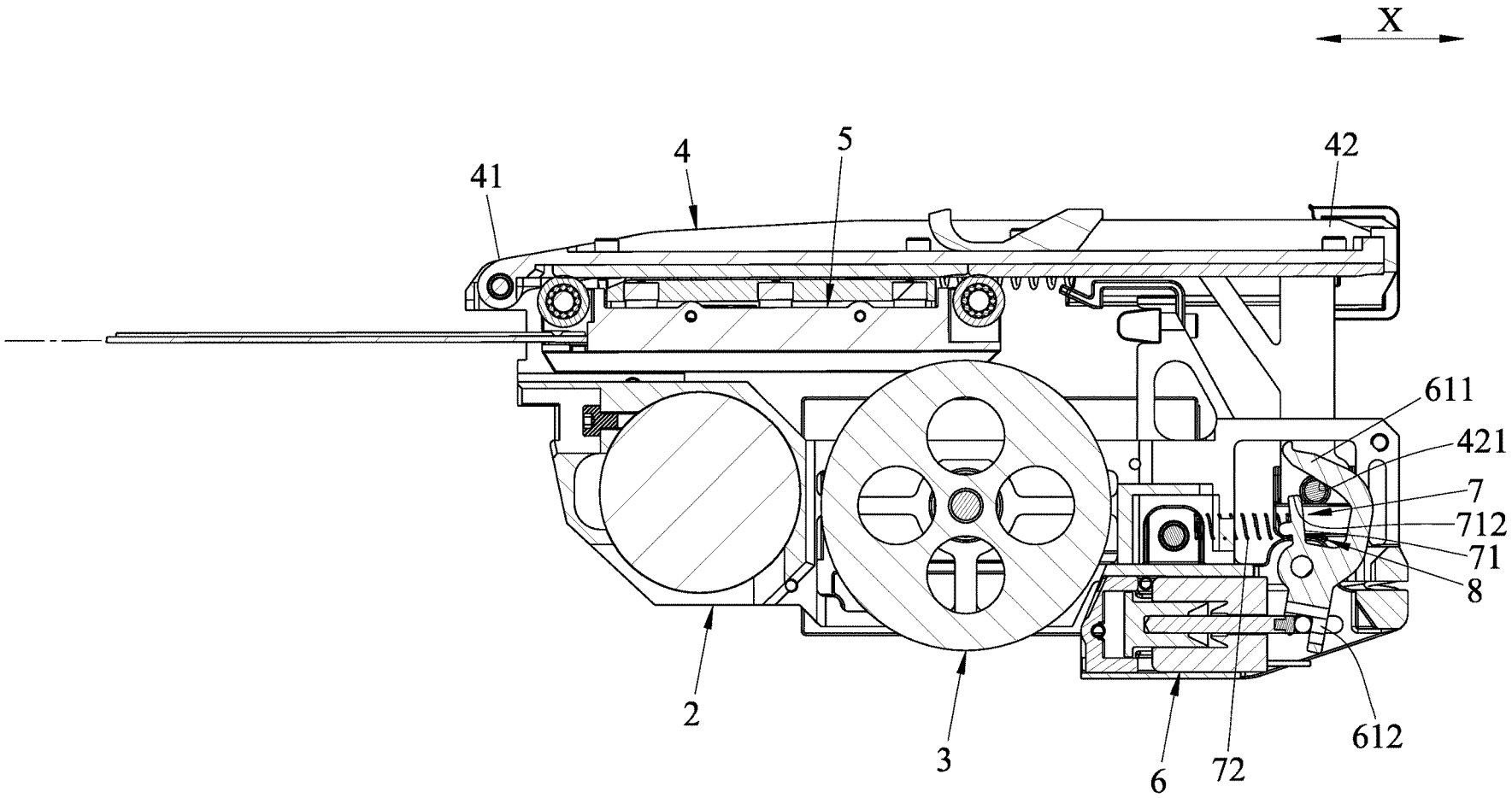
FIG. 9 is a partial sectional view, illustrating a stopping member of the second embodiment in a releasing position.

Referring to FIGS. 8 and 9, a second embodiment of an electric nail gun according to the disclosure is similar to the first embodiment, but differs in that the stopping member 71 and the driving member 61 are molded as one piece such that the rotation of the driving member 61 in the rotational direction drives the stopping member 71 to move from the stopping position (FIG. 8) towards the releasing position (FIG. 9). As such, the abutting surface 711 of the stopping member 71 in the first embodiment is obsolete.

When the electric nail gun is in standby, the stopping member 71 is at the stopping position to similarly block the swing arm 4 from moving towards the shooting position with the stopping surface 712.

When electricity is supplied to cause the valve rod set 621 of the electromagnetic valve 62 to extend, like in the first embodiment, the driving member 61 is driven by the valve rod set 621 to rotate in the rotational direction, and the stopping member 71 co-rotates with the first rotating arm 611 to the releasing position, allowing the swing arm 4 to move towards the flywheel 3 to the shooting position.

It should be noted that as the stopping member 71 is formed as one piece with the driving member 61, the safety resilient member 72 is optional in the second embodiment and may thus be omitted in variations of the second embodiment.

In sum, the advantage of the electric nail gun of the disclosure lies in that, by providing the stopping member 71 which is drivable by the driving member 61 to prevent the swing arm 4 from moving from the standby position to the shooting position, the configuration of the disclosure ensures that the swing arm 4 can only move when driven by the driving member 61, preventing accidental activation of the electric nail gun by an external force. This improves the safety of the electric nail gun.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. An electric nail gun comprising:

a supporting frame;

a flywheel rotatably connected to said supporting frame;

a swing arm connected to said supporting frame and having a driven segment, said swing arm being pivotable relative to said supporting frame between a standby position, where said swing arm is distal from said flywheel, and a shooting position, where said swing arm is proximal to said flywheel;

an impact member mounted to said swing arm, said impact member contacting said flywheel and being driven by said flywheel to move in a longitudinal direction when said swing arm is at the shooting position;

a driving unit including a driving member that is in direct physical contact with said driven segment of said swing arm and that is operable for moving said swing arm towards the shooting position; and a safety unit having a stopping member that is in direct physical contact with and driven by said driving member to move relative to said driven segment between a stopping position, where said stopping member blocks movement of said driven segment to prevent said swing arm from moving towards the shooting position, and a releasing position, where the movement of said driven segment is not blocked such that movement of said swing arm towards the shooting position is permitted.

2. The electric nail gun as claimed in claim 1, wherein said swing arm includes a pivot end portion pivotally connected to said supporting frame, and a swing end portion opposite to said pivot end portion and having said driven segment, said driven segment being rod-shaped and extending in a width direction which is perpendicular to the longitudinal direction.

3. The electric nail gun as claimed in claim 2, wherein:

said driving member is mounted rotatably to said supporting frame, and has opposite first and second rotating arms, said first rotating arm being in sliding contact with said driven segment of said swing arm such that rotation of said driving member in a rotational direction drives said swing arm to move towards the shooting position; and said driving unit further includes an electromagnetic valve mounted to said supporting frame, connected to said second rotating arm and operable for generating a force to rotate said driving member in the rotational direction.

4. The electric nail gun as claimed in claim 3, wherein:

said stopping member is mounted to said supporting frame, and has a stopping surface that is disposed on a route of said driven segment during the movement of said swing arm from the standby position to the shooting position when said stopping member is at the stopping position, and that is away from the route of said driven segment during the movement of said swing arm from the standby position to the shooting position when said stopping member is at the releasing position;

said stopping member further has an abutting surface that is in contact with said first rotating arm such that the rotation of said driving member in the rotational direction drives said stopping member to move towards the releasing position; and said safety unit further includes a safety resilient member that is connected between said stopping member and said supporting frame for biasing said stopping member towards the stopping position.

5. The electric nail gun as claimed in claim 4, wherein said stopping member further has a recess engaged with an end portion of said safety resilient member.

6. The electric nail gun as claimed in claim 4, wherein said stopping surface and said abutting surface are not parallel to each other.

7. The electric nail gun as claimed in claim 3, wherein:

said stopping member and said driving member are molded as one piece such that the rotation of said driving member in the rotational direction drives said stopping member to move towards the releasing position; and said stopping member has a stopping surface that is disposed on a route of said driven segment during the movement of said swing arm from the standby position to the shooting position when said stopping member is at the stopping position, and that is away from the route of said driven segment during the movement of said swing arm from the standby position to the shooting position when said stopping member is at the releasing position.

8. The electric nail gun as claimed in claim 7, wherein said safety unit further includes a safety resilient member connected between said supporting frame and said stopping member for biasing said stopping member towards the stopping position.

* * * * *